US007803247B2

(12) United States Patent
Levit et al.

(10) Patent No.: US 7,803,247 B2
(45) Date of Patent: Sep. 28, 2010

(54) PAPERS CONTAINING FLOC DERIVED FROM DIAMINO DIPHENYL SULFONE

(75) Inventors: Mikhail R. Levit, Glen Allen, VA (US); Vlodek Gabara, Richmond, VA (US); Gary Lee Hendren, Richmond, VA (US)

(73) Assignee: E.I. du Pont de Nemours and Company, Wilmington, DE (US)

( * ) Notice: Subject to any disclaimer, the term of this patent is extended or adjusted under 35 U.S.C. 154(b) by 0 days.

(21) Appl. No.: 12/004,901

(22) Filed: Dec. 21, 2007

(65) Prior Publication Data

US 2009/0162605 A1 Jun. 25, 2009

(51) Int. Cl.
*D21H 13/20* (2006.01)
*D21H 13/26* (2006.01)

(52) U.S. Cl. ..... 162/146; 162/157.3; 162/138; 162/123; 428/116; 428/537.5; 428/105; 428/113; 428/299.7

(58) Field of Classification Search ..... 162/141, 162/146, 157.1–157.4, 138; 428/105, 113, 428/116, 212, 221, 292.1, 299.7, 323, 327, 428/220, 73, 537.5, 172; 442/327, 333, 414, 442/415

See application file for complete search history.

(56) References Cited

U.S. PATENT DOCUMENTS

| | | | | | |
|---|---|---|---|---|---|
| 2,988,782 | A | | 6/1961 | Guandique et al. | |
| 2,999,788 | A | | 9/1961 | Morgan | |
| 3,018,091 | A | | 1/1962 | Duggins | |
| 3,063,966 | A | | 11/1962 | Kwolek et al. | |
| 3,227,793 | A | | 1/1966 | Cipriani | |
| 3,287,324 | A | | 11/1966 | Swseny | |
| 3,356,760 | A | * | 12/1967 | Matray | 525/133 |
| 3,414,645 | A | | 12/1968 | Morgan | |
| 3,756,908 | A | | 9/1973 | Gross | |
| 3,767,756 | A | | 10/1973 | Blades | |
| 3,869,429 | A | | 3/1975 | Blades | |
| 3,869,430 | A | | 3/1975 | Blades | |
| 4,075,172 | A | * | 2/1978 | Ozawa et al. | 528/183 |
| 4,162,275 | A | * | 7/1979 | Moulds | 525/428 |
| 4,169,932 | A | | 10/1979 | Sokolov et al. | |
| 4,654,100 | A | * | 3/1987 | Yats et al. | 156/246 |
| 5,026,456 | A | | 6/1991 | Hesler et al. | |
| 5,089,088 | A | * | 2/1992 | Hendren et al. | 162/123 |
| 5,126,012 | A | * | 6/1992 | Hendren et al. | 162/146 |
| 5,223,094 | A | * | 6/1993 | Kirayoglu et al. | 162/145 |
| 5,371,153 | A | * | 12/1994 | Kuribayashi et al. | 525/423 |
| 5,393,601 | A | * | 2/1995 | Heinrich et al. | 442/411 |
| 5,431,782 | A | * | 7/1995 | Cassat | 162/145 |
| 5,578,368 | A | * | 11/1996 | Forsten et al. | 442/407 |
| 5,621,067 | A | * | 4/1997 | Lin et al. | 528/310 |
| 5,667,743 | A | | 9/1997 | Tai et al. | |
| 5,910,231 | A | * | 6/1999 | Kirayoglu et al. | 162/145 |
| 7,459,044 | B2 | * | 12/2008 | Khan et al. | 156/62.2 |
| 2002/0142689 | A1 | * | 10/2002 | Levit | 442/381 |
| 2003/0082974 | A1 | * | 5/2003 | Samuels et al. | 442/327 |
| 2003/0087077 | A1 | * | 5/2003 | Samuels et al. | 428/292.1 |
| 2003/0162457 | A1 | * | 8/2003 | Berrigan et al. | 442/327 |
| 2004/0089432 | A1 | * | 5/2004 | Levit | 162/157.3 |
| 2004/0132372 | A1 | * | 7/2004 | Samuels et al. | 442/327 |
| 2005/0136233 | A1 | * | 6/2005 | Samuels et al. | 428/212 |
| 2005/0230072 | A1 | * | 10/2005 | Levit | 162/146 |
| 2006/0266486 | A1 | * | 11/2006 | Levit | 162/146 |
| 2007/0137818 | A1 | * | 6/2007 | Levit et al. | 162/146 |
| 2008/0057807 | A1 | * | 3/2008 | Tutterow et al. | 442/1 |
| 2008/0145596 | A1 | * | 6/2008 | Levit et al. | 428/116 |
| 2008/0242827 | A1 | * | 10/2008 | Wang et al. | 528/172 |
| 2008/0286522 | A1 | * | 11/2008 | Khan et al. | 428/116 |
| 2009/0053961 | A1 | * | 2/2009 | Gabara | 442/414 |
| 2009/0095400 | A1 | * | 4/2009 | Stelter et al. | 156/60 |
| 2009/0142567 | A1 | * | 6/2009 | Kanakarajan et al. | 428/220 |
| 2009/0159226 | A1 | * | 6/2009 | Levit et al. | 162/146 |
| 2009/0159227 | A1 | * | 6/2009 | Levit et al. | 162/146 |
| 2009/0162605 | A1 | * | 6/2009 | Levit et al. | 428/116 |
| 2009/0214818 | A1 | * | 8/2009 | Levit et al. | 428/116 |
| 2009/0236064 | A1 | * | 9/2009 | Merriman et al. | 162/146 |
| 2009/0250181 | A1 | * | 10/2009 | Levit | 162/146 |

FOREIGN PATENT DOCUMENTS

| | | | | |
|---|---|---|---|---|
| CN | 1389604 | A | | 1/2003 |
| CN | 1631941 | A | | 6/2005 |
| EP | 426191 | A1 | * | 5/1991 |
| EP | 446870 | A1 | * | 9/1991 |
| EP | 1975285 | A2 | * | 10/2008 |
| JP | 05033289 | A | * | 2/1993 |
| JP | 06047759 | A | * | 2/1994 |
| WO | WO 02/059411 | A2 | * | 8/2002 |
| WO | WO 2007075575 | A2 | * | 7/2007 |
| WO | WO 2007076334 | A2 | * | 7/2007 |
| WO | WO 2007076343 | A2 | * | 7/2007 |
| WO | WO 2008027454 | A1 | * | 3/2008 |

OTHER PUBLICATIONS

Machine Translation of Chinese Publication No. 1389604, Published on Jan. 8, 2003.*
Machine Translation of Chinese Publication No. 1631941, Published on Jun. 29, 2005.*

* cited by examiner

*Primary Examiner*—José A Fortuna

(57) ABSTRACT

This invention relates to papers made with floc containing a polymer or copolymer derived from a monomer selected from the group consisting of 4,4'diaminodiphenyl sulfone, 3,3'diaminodiphenyl sulfone, and mixtures thereof. Such papers have higher elongation-at-break and work-to-break (toughness) properties and exhibit less shrinkage at high temperatures than papers made with solely with poly (metaphenylene isophthalamide) floc.

11 Claims, No Drawings

PAPERS CONTAINING FLOC DERIVED FROM DIAMINO DIPHENYL SULFONE

BACKGROUND OF THE INVENTION

1. Field of the Invention

This invention relates to papers made with floc containing a polymer or copolymer derived from a monomer selected from the group consisting of 4,4'diaminodiphenyl sulfone, 3,3'diaminodiphenyl sulfone, and mixtures thereof. Such papers have higher elongation-at-break and work-to-break (toughness) properties and exhibit less shrinkage at high temperatures than papers made with solely with poly (metaphenylene isophthalamide) floc.

2. Description of Related Art

Papers made from high performance materials have been developed to provide papers with improved strength and/or thermal stability. Aramid paper, for example, is synthetic paper composed of aromatic polyamides. Because of its heat and flame resistance, electrical insulating properties, toughness and flexibility, the paper has been used as electrical insulation material and a base for aircraft honeycombs. Of these materials, Nomex® of DuPont (U.S.A.) is manufactured by mixing poly(metaphenylene isophthalamide) floc and fibrids in water and then subjecting the mixed slurry to papermaking process to make formed paper followed by hot calendering of the formed paper. This paper is known to have excellent electrical insulation properties and with strength and toughness, which remains high even at high temperatures.

However, there is an ongoing need for high performance papers with improved properties, particularly papers that have improved elongation and toughness and that are more dimensionally stable at high temperatures.

BRIEF SUMMARY OF THE INVENTION

In one embodiment, this invention relates to a paper useful for electrical insulation, comprising floc containing a polymer or copolymer derived from a monomer selected from the group consisting of 4,4'diaminodiphenyl sulfone, 3,3'diaminodiphenyl sulfone, and mixtures thereof, the floc having a length of from 2 to 25 mm; and non-granular, fibrous or film-like polymer fibrids, the fibrids containing a polymer or copolymer derived from metaphenylene diamine, the fibrids having an average maximum dimension of 0.1 to 1 mm, a ratio of maximum to minimum dimension of 5:1 to 10:1, and a thickness of no more than 2 microns. (As employed herein "film-like" means "film").

In another embodiment, this invention relates to a process for making a paper useful for electrical insulation comprising the steps of:

a) forming an aqueous dispersion of 97 to 5 parts by weight of a floc containing a polymer or copolymer derived from a monomer selected from the group consisting of 4,4'diaminodiphenyl sulfone, 3,3'diaminodiphenyl sulfone, and mixtures thereof; and 3 to 95 parts by weight polymer fibrids based on the total weight of the floc and fibrids, the fibrids containing a polymer or copolymer derived from metaphenylene diamine;

b) blending the dispersion to form a slurry, c) draining the aqueous liquid from the slurry to yield a wet paper composition, and d) drying the wet paper composition to make a formed paper.

If desired, the process includes the additional step of densifying the formed paper under heat and pressure to make a calendered paper.

DETAILED DESCRIPTION OF THE INVENTION

This invention relates to a paper having improved toughness and dimensional stability at high temperatures. Key to this invention is the use of a floc containing a polymer or copolymer derived from a monomer selected from the group consisting of 4,4'diaminodiphenyl sulfone, 3,3'diaminodiphenyl sulfone, and mixtures thereof.

By "floc" is meant fibers having a length of 2 to 25 millimeters, preferably 3 to 7 millimeters and a diameter of 3 to 20 micrometers, preferably 5 to 14 micrometers. If the floc length is less than 3 millimeters, the paper strength is severely reduced, and if the floc length is more than 25 millimeters, it is difficult to form a uniform paper web by a typical wet-laid method. If the floc diameter is less than 5 micrometers, it can be difficult to commercially produce with adequate uniformity and reproducibility, and if the floc diameter is more than 20 micrometers, it is difficult to form uniform paper of light to medium basis weights. Floc is generally made by cutting continuous spun filaments into specific-length pieces.

The floc comprises a polymer or copolymer derived from an amine monomer selected from the group consisting of 4,4'diaminodiphenyl sulfone, 3,3'diaminodiphenyl sulfone, and mixtures thereof. Such polymers and copolymers generally having the structure:

NH2-Ar1-SO2-Ar2-NH2 wherein Ar1 and Ar2 are any unsubstituted or substituted six-membered aromatic group of carbon atoms and Ar1 and Ar2 can be the same or different. In some preferred embodiments Ar1 and Ar2 are the same. Still more preferably, the six-membered aromatic group of carbon atoms has meta- or para-oriented linkages versus the SO2 group. This monomer or multiple monomers having this general structure are reacted with an acid monomer in a compatible solvent to create a polymer. Useful acids monomers generally have the structure of

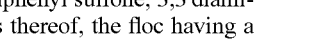

Cl—CO—Ar3-CO—Cl wherein Ar3 is any unsubstituted or substituted aromatic ring structure and can be the same or different from Ar1 and/or Ar2. In some preferred embodiments Ar3 is a six-membered aromatic group of carbon atoms. Still more preferably, the six-membered aromatic group of carbon atoms has meta- or para-oriented linkages. In some preferred embodiments Ar1 and Ar2 are the same and Ar3 is different from both Ar1 and Ar2. For example, Ar1 and Ar2 can be both benzene rings having meta-oriented linkages while Ar3 can be a benzene ring having para-oriented linkages. Examples of useful monomers include terephthaloyl chloride, isophthaloyl chloride, and the like. In some preferred embodiments, the acid is terephthaloyl chloride or its mixture with isophthaloyl chloride and the amine monomer is 4,4'diaminodiphenyl sulfone. In some other preferred embodiments, the amine monomer is a mixture of 4,4'diaminodiphenyl sulfone and 3,3'diaminodiphenyl sulfone in a weight ratio of 3:1, which creates a floc made from a copolymer having both sulfone monomers.

In still another preferred embodiment, the floc contains a copolymer, the copolymer having both repeat units derived from sulfone amine monomer and an amine monomer derived from paraphenylene diamine and/or metaphenylene diamine. In some preferred embodiments the sulfone amide repeat units are present in a weight ratio of 3:1 to other amide repeat units. In some embodiments, at least 80 mole percent of the amine monomers is a sulfone amine monomer or a mixture of sulfone amine monomers. For convenience, herein the abbreviation "PSA" will be used to represent all of the entire classes of fibers made with polymer or copolymer derived from sulfone monomers as previously described.

In one embodiment, the polymer and copolymer derived from a sulfone monomer can preferably be made via polycondensation of one or more types of diamine monomer with one or more types of chloride monomers in a dialkyl amide solvent suchs as N-methyl pyrrolidone, dimethyl acetamide, or mixtures thereof. In some embodiments of the polymerizations of this type an inorganic salt such as lithium chloride or calcium chloride is also present. If desired the polymer can be isolated by precipitation with non-solvent such as water, neutralized, washed, and dried. The polymer can also be made via interfacial polymerization which produces polymer powder directly that can then be dissolved in a solvent for fiber production.

Specific methods of making PSA fibers or copolymers containing sulfone amine monomers are disclosed in Chinese Patent Publication 1389604A to Wang et al. This reference discloses a fiber known as polysulfonamide fiber made by spinning a copolymer solution formed from a mixture of 50 to 95 weight percent 4,4'diaminodiphenyl sulfone and 5 to 50 weight percent 3,3'diaminodiphenyl sulfone copolymerized with equimolar amounts of terephthaloyl chloride in dimethylacetamide. Chinese Patent Publication 1631941A to Chen et al. also discloses a method of preparing a PSA copolymer spinning solution formed from a mixture of 4,4'diaminodiphenyl sulfone and 3,3'diaminodiphenyl sulfone in a mass ratio of from 10:90 to 90:10 copolymerized with equimolar amounts of terephthaloyl chloride in dimethylacetamide. Still another method of producing copolymers is disclosed in U.S. Pat. No. 4,169,932 to Sokolov et al. This reference discloses preparation of poly(paraphenylene) terephthalamide (PPD-T) copolymers using tertiary amines to increase the rate of polycondensation. This patent also discloses the PPD-T copolymer can be made by replacing 5 to 50 mole percent of the paraphenylene diamine (PPD) by another aromatic diamine such as 4,4'diaminodiphenyl sulfone.

The PSA floc is combined with polymer fibrids containing a polymer or copolymer derived from metaphenylene diamine. In one embodiment, the preferred polymer or copolymers are meta-aramid polymers. In one preferred embodiment the polymer is poly(metaphenylene isophthalamide) (MPD-I).

The term "fibrids" as used herein, means a very finely-divided polymer product of small, filmy, essentially two-dimensional, particles known having a length and width on the order of 100 to 1000 micrometers and a thickness only on the order of 0.1 to 1 micrometer. Fibrids are made by streaming a polymer solution into a coagulating bath of liquid that is immiscible with the solvent of the solution. The stream of polymer solution is subjected to strenuous shearing forces and turbulence as the polymer is coagulated.

Preferably, fibrids have a melting point or decomposition point above 320° C. Fibrids are not fibers, but they are fibrous in that they have fiber-like regions connected by webs. In on embodiment, fibrids have an aspect ratio of 5:1 to 10:1. In another embodiment, fibrids are used wet in a never-dried state and can be deposited as a binder physically entwined about other ingredients or components of a paper. The fibrids can be prepared by any method including using a fibridating apparatus of the type disclosed in U.S. Pat. No. 3,018,091 where a polymer solution is precipitated and sheared in a single step. Fibrids can also be made via the processes disclosed in U.S. Pat. Nos. 2,988,782 and 2,999,788.

By aramid is meant a polyamide wherein at least 85% of the amide (—CONH—) linkages are attached directly to two aromatic rings. A meta-aramid is such a polyamide that contains a meta configuration or meta-oriented linkages in the polymer chain. Additives can be used with the aramid and, in fact, it has been found that up to as much as 10 percent, by weight, of other polymeric material can be blended with the aramid or that copolymers can be used having as much as 10 percent of other diamine substituted for the diamine of the aramid or as much as 10 percent of other diacid chloride substituted for the diacid chloride of the aramid. Meta-aramid polymers are inherently flame resistant; U.S. Pat. Nos. 3,063,966; 3,227,793; 3,287,324; 3,414,645; and 5,667,743 are illustrative of useful methods for making aramid polymers and fibrous materials.

The PSA floc and MPD-I polymer fibrids are combined to form a dimensionally stable paper having improved elongation and toughness and reduced shrinkage at high temperature. As employed herein the term paper is employed in its normal meaning and it can be prepared using conventional paper-making processes and equipment and processes. The fibrous material, i.e. fibrids and floc, can be slurried together to from a mix which is converted to paper such as on a Fourdrinier machine or by hand on a handsheet mold containing a forming screen. Reference may be made to Gross U.S. Pat. No. 3,756,908 and Hesler et al. U.S. Pat. No. 5,026,456 for processes of forming fibers into papers. If desired, once paper is formed it is calendered between two heated calendering rolls with the high temperature and pressure from the rolls increasing the bond strength of the paper. Calendering also provides the paper with a smooth surface for printing.

In one embodiment, the paper has a weight ratio of fibrids to floc in the paper composition of from 95:5 to 3:97. In one preferred embodiment, the paper has a weight ratio of fibrids to floc in the paper composition of from 60:40 to 10:90.

In one embodiment, the formed paper has a density of about 0.1 to 0.5 grams per cubic centimeter. In some embodiments the thickness of the formed paper ranges from about 0.002 to 0.015 inches. The thickness of the calendered paper is dependent upon the end use or desired properties and in some embodiments is typically from 0.001 to 0.005 mils (25 to 130 micrometers) thick. In some embodiments, the basis weight of the paper is from 0.5 to 6 ounces per square yard (15 to 200 grams per square meter).

Papers containing PSA floc have significantly improved elongation-at-break and work-to-break (toughness) properties when compared to similar papers made with MPD-I floc. In some embodiments, the papers having PSA floc have at least a 50% improvement in both elongation-at-break values and work-to-break values for similar papers made with MPD-I floc. In some preferred embodiments the papers have at least a 70% improvement in at least one of these properties. In addition, in some embodiments only a small portion of the MPD-I floc needs to be replaced PSA floc to show some improvement in these values. In these embodiments, it is believed an improvement in elongation-at-break and work-to-break properties can be seen by replacing as little as 20 weight percent of the MPD-I floc with PSA floc.

In addition, from papers containing PSA floc have reduced thermal shrinkage at 300 degrees Celsius over papers containing only MPD-I floc, which translates to improved dimensional stability of these papers at elevated temperatures. In some embodiments the measured improvement in shrinkage is a reduction in shrinkage at 300° C. of at least one third.

If desired, other flocs can be combined with the PSA floc as long as at least 20 weight percent of the floc is PSA floc. Suitable other flocs include those selected from the group of para-aramid, meta-aramid, carbon, glass, polyethylene terephthalate, polyethylene napthalate, liquid crystalline polyesters, polyphenylene sulfide, polyether-ketone-ketone, polyether-ether-ketone, polyoxadiazole, polybenzazole, and mixtures thereof. Generally these flocs also have a length of from 1.0 to 15 mm. In one preferred embodiment, these additional flocs are made from thermally stable polymers. For purposes herein thermally stable means the polymer has a glass transition temperature of greater than 150 degrees Celsius.

In one preferred embodiment, the preferred additive floc is MPD-I floc. One such meta-aramid floc is Nomex® aramid fiber available from E. I. du Pont de Nemours and Company of Wilmington, Del., however, meta-aramid fibers are available in various styles under the trademarks Conex®, available from Teijin Ltd. of Tokyo, Japan,; Apyeil®, available from Unitika, Ltd. of Osaka, Japan; New Star® Meta-aramid, available from Yantai Spandex Co. Ltd, of Shandong Province, China; and Chinfunex® Aramid 1313 available from Guangdong Charming Chemical Co. Ltd., of Xinhui in Guangdong, China. Meta-aramid fibers are inherently flame resistant and can be spun by dry or wet spinning using any number of processes; however, U.S. Pat. Nos. 3,063,966; 3,227,793; 3,287,324; 3,414,645; and 5,667,743 are illustrative of useful methods for making aramid fibers that could be used.

In another preferred embodiment, the preferred additive floc is para-aramid floc, especially poly(paraphenylene terephthalamide) floc. A para-aramid is an aromatic polyamide that contains a para configuration or para-oriented linkages in the polymer chain. Methods for making para-aramid fibers useful are generally disclosed in, for example, U.S. Pat. Nos. 3,869,430; 3,869,429; and 3,767,756. Various forms of such aromatic polyamide organic fibers are sold under the trademarks of Kevlar® and Twaron® by respectively, E. I. du Pont de Nemours and Company, of Wilmington, Del.; and Teijin, Ltd, of Japan. Also, fibers based on copoly(p-phenylene/3,4'-diphenyl ether terephthalamide) are defined as para-aramid fibers as used herein. One commercially available version of these fibers is known as Technora® fiber also available from Teijin, Ltd.

In another embodiment, a portion of the MPD-I fibrids can be replaced by fibrids made from PSA polymer or copolymer. Such fibrids can be made in a similar manner to the MPD-I fibrids. In one embodiment, it is believed that at least 80 weight percent of the MPD-I fibrids can be replaced with PSA fibrids with good result. However, in a preferred embodiment, 20 to 50 weight percent of the MPD-I fibrids are replaced with PSA fibrids. It is believed the addition of PSA fibrids will provide a paper having improved dyeability and printability due to the additional polysulfone groups provided by the PSA fibrids.

Additional ingredients such as fillers for the adjustment of paper conductivity and other properties, pigments, antioxidants, etc in powder or fibrous form can be added to the paper composition of this invention. If desired, an inhibitor can be added to the paper to provide resistance to oxidative degradation at elevated temperatures. Preferred inhibitors are oxides, hydroxides and nitrates of bismuth. An especially effective inhibitor is a hydroxide and nitrate of bismuth. One desired method of incorporating such fillers into the papers is by first incorporating the fillers into the fibrids during fibrid formation. Other methods of incorporating additional ingredients into the paper include adding such components to the slurry during paper forming, spraying the surface of the formed paper with the ingredients and other conventional techniques.

In one embodiment, this invention relates to a process for making a paper useful for electrical insulation comprising the steps of:

a) forming an aqueous dispersion of 97 to 5 parts by weight of a floc containing a polymer or copolymer derived from an amine monomer selected from the group consisting of 4,4'diaminodiphenyl sulfone, 3,3'diaminodiphenyl sulfone, and mixtures thereof; and 3 to 95 parts by weight polymer fibrids based on the total weight of the floc and fibrids, the fibrids containing a polymer or copolymer derived from metaphenylene diamine;

b) blending the dispersion to form a slurry, c) draining the aqueous liquid from the slurry to yield a wet paper composition, and d). drying the wet paper composition to make a formed paper.

The paper can be formed on equipment of any scale from laboratory screens to commercial-sized papermaking machinery, such as a Fourdrinier or inclined wire machines. The general process involves making a dispersion of the fibrids and floc, and optionally additional ingredients such as fillers, in an aqueous liquid, draining the liquid from the dispersion to yield a wet composition and drying the wet paper composition.

The dispersion can be made either by dispersing the floc in the aqueous liquid and then adding the fibrids or by dispersing the fibrids in the liquid and then adding the fibers. The dispersion can also be made by combining a floc-containing dispersion with a fiber-containing dispersion. The concentration of floc in the dispersion can range from 0.01 to 1.0 weight percent based on the total weight of the dispersion. The concentration of a fibrids in the dispersion can be up to 20 weight percent based on the total weight of solids.

The aqueous liquid of the dispersion is generally water, but may include various other materials such as pH-adjusting materials, forming aids, surfactants, defoamers and the like. The aqueous liquid is usually drained from the dispersion by conducting the dispersion onto a screen or other perforated support, retaining the dispersed solids and then passing the liquid to yield a wet paper composition. The wet composition, once formed on the support, is usually further dewatered by vacuum or other pressure forces and further dried by evaporating the remaining liquid.

A next step, which can be performed if higher density and strength are desired, is calendering one or more layers of the paper in the nip of metal-metal, metal-composite, or composite-composite rolls. Alternatively, one or more layers of the paper can be compressed in a platen press at a pressure, temperature and time, which are optimal for a particular composition and final application. Also, heat-treatment as an independent step before, after or instead of calendering or compressing, can be conducted if strengthening or some other property modification is desired without or in addition to densification.

The paper is useful in applications where thermal dimensional stability and toughness is desired, such as printed wiring boards; or where dielectric properties are useful, such as electrical insulating material for use in motors, transformers and other power equipment. In these applications, the paper can be used by itself or in laminate structures either with or without impregnating resins, as desired. In another embodiment, the paper is used as an electrical insulative wrapping for wires and conductors. The wire or conductor can be totally wrapped, such a spiral overlapping wrapping of the wire or conductor, or can wrap only a part or one or more sides of the conductor as in the case of square conductors. The amount of wrapping is dictated by the application and if desired multiple layers of the paper can be used in the wrapping. In another embodiment, the paper can also be used as a component in structural materials such as core structures or honeycombs. For example, one or more layers of the paper may be used as the primarly material for forming the cells of a honeycomb structure. Alternatively, one or more layers of the paper may be used in the sheets for covering or facing the honeycomb cells or other core materials. Preferably, these papers and/or structures are impregnated with a resin such as a phenolic, epoxy, polyimide or other resin. However, in some instances the paper may be useful without any resin impregnation.

Test Methods

Thickness and Basis Weight (Grammage) were determined for papers of this invention in accordance with ASTM D 374 and ASTM D 646 correspondingly. At thickness measurements, method E with pressure on specimen of about 172 kPa was used.

Density (Apparent Density) of papers was determined in accordance with ASTM D 202.

Elongation and Work-to-Break (Toughness) are determined for papers on an Instron-type testing machine using test specimens 2.54 cm wide and a gage length of 18 cm in accordance with ASTM D 828.

Shrinkage at 300° C. was determined for the papers using specimens 2.54 cm wide and 20 cm long. The specimens were dried in the oven at 120° C. for 1 hour, then cooled down to room temperature in the dessicator, and their length was measured. After that, the specimens were placed in the oven with temperature of 300° C. and held at that temperature for 20 minutes. The specimens were then cooled down to room temperature in the dessicator, and their length was measured once more. The shrinkage at 300° C. in percent was calculated as:

$$(L_o-L)/L_o\times 100\%,$$

Where $L_o$ is the initial length of dry specimen; and L is the length of dry specimen after exposure to 300° C. The result was rounded to the nearest 0.1%.

EXAMPLE 1

An aqueous dispersion of never-dried poly(metaphenylene isophthalamide) (MPD-I) fibrids at a 0.5% consistency (0.5 weight percent solid materials in water) was made as described in U.S. Pat No. 3,756,908. After five additional minutes of agitation, water was added to yield a final consistency of 0.2%. After ten minutes of continued agitation, floc made from Tanlon® PSA fiber, which is fiber made from a copolymer of 4,4'diaminodiphenyl sulfone and 3,3'diaminodiphenyl sulfone, was added. The floc had a linear density 0.17 tex (1.5 denier) and a cut length of 0.64 cm. The solid materials were mixed in the dispersion in an amount that resulted in a dispersion consisting of 53 weight percent MPD-I fibrids and 47 weight percent PSA floc.

The resulting dispersion was pumped to a supply chest and fed from there to a Fourdrinier machine to make paper with a basis weight of 39.0 g/m$^2$. Other properties of the paper are described in the Table 1 below.

EXAMPLE 2

The process of Example 1 were repeated, except that additionally MPD-I floc was added to the dispersion. The MPD-I floc was made from Nomex® aramid fiber sold by DuPont and had a linear density 0.22 tex (2.0 denier) and a cut length of 0.64 cm. The solid materials were mixed in the dispersion in an amount that resulted in a dispersion consisting of 53 weight percent MPD-I fibrids, 24 weight percent PSA floc, and 23 weight percent MPD-I floc.

The resulting paper had a basis weight of 39.0 g/m$^2$; other properties of the paper are described in the Table 1 below.

COMPARATIVE EXAMPLE A

A slurry was prepared as in Example 1, but the PSA floc was replaced with the MPD-I floc of Example 2. The solid materials were mixed in the dispersion in an amount that resulted in a dispersion consisting of 53 weight percent MPD-I fibrids and 47 weight percent MPD-I floc.

The resulting paper had a basis weight of 40.0 g/m$^2$; other properties of the paper are described in the Table 1 below.

EXAMPLE 3

A mixture of 1.41 grams (based on dry weight) of the PSA floc (as described in Example 1) in 300 ml of water was placed in a Waring Blender and agitated for 1 min. This mixture was then combined with a slurry of 274 grams of an aqueous, never-dried, MPD-I fibrid slurry (0.58% consistency and freeness 330 ml of Shopper-Riegler) in a laboratory mixer (British pulp evaluation apparatus) with about 1600 g of water and agitated for 1 min. The solid materials were mixed in the dispersion in an amount that resulted in a dispersion consisting of 53 weight percent MPD-I fibrids and 47 weight percent PSA floc.

The dispersion was poured, with 8 liters of water, into an approximately 21×21 cm handsheet mold and a wet-laid sheet was formed. The sheet was placed between two pieces of blotting paper, hand couched with a rolling pin, and dried in a handsheet dryer at 190° C. After drying, the sheet was compressed in the platen press at pressure of about 5.7 MPa and temperature of about 288 C for 2 minutes. The final paper had a basis weight of 66.8 g/m$^2$; other properties of the paper are described in the Table 2 below.

COMPARATIVE EXAMPLE B

Example 3 was repeated, except that a MPD-I floc, as described in Example 2, replaced the PSA floc. The final paper had a basis weight of 67.8 g/m$^2$; other properties of the paper are described in the Table 2 below.

EXAMPLE 4

Example 3 was repeated except 2.1 grams (based on dry weight) of PSA floc was used and the solid materials were mixed in the dispersion in an amount that resulted in a dispersion consisting of 30 weight percent MPD-I fibrids and 70 weight percent PSA floc. The final paper had a basis weight of 67.8 g/m$^2$; other properties of the paper are described in the Table 2 below.

COMPARATIVE EXAMPLE C

Example 4 was repeated, except that a MPD-I floc, as described in Example 2, replaced the PSA floc. The final paper had a basis weight of 69.8 g/m$^2$; other properties of the paper are described in the Table 2 below.

EXAMPLE 5

A mixture of 2.55 grams (based on dry weight) of the PSA floc (as described in Example 1) in 300 ml of water was placed in a Waring Blender and agitated for 1 min. This mixture was then combined with a slurry of 77.6 grams of an aqueous, never-dried, MPD-I fibrid slurry (0.58% consistency and freeness 330 ml of Shopper-Riegler) in a laboratory mixer (British pulp evaluation apparatus) with about 1600 g of water and agitated for 1 min. The solid materials were mixed in the dispersion in an amount that resulted in a dispersion consisting of 15 weight percent MPD-I fibrids and 85 weight percent PSA floc.

The dispersion was poured, with 8 liters of water, into an approximately 21×21 cm handsheet mold and a wet-laid sheet was formed. The sheet was placed between two pieces of blotting paper, hand couched with a rolling pin and dried in a handsheet dryer at 190° C. After drying, the sheet was compressed in the platen press at pressure of about 5.7 MPa and temperature of about 288 C for 2 minutes. The final paper had a basis weight of 67.8 g/m$^2$; other properties of the paper are described in the Table 2 below.

COMPARATIVE EXAMPLE D

Example 5 was repeated, except that a MPD-I floc, as described in Example 2, replaced the PSA floc. The final paper had a basis weight of 70.2 g/m$^2$; other properties of the paper are described in the Table 2 below.

As shown in Tables 1 & 2, papers having PSA floc showed improved elongation-at-break and work-to-break (toughness). The improvement over the comparison papers having only MPD-I floc was significant. The examples also illustrate that only a small percentage of PSA floc is needed to affect a major increase in elongation-at-break and work-to-break properties. In addition, from Table 2 it is clear that papers containing PSA floc having reduced shrinkage at 300 degrees Celsius over papers containing only MPD-I floc.

What is claimed is:

1. A paper useful for electrical insulation, comprising:

a) at least 20 weight percent floc containing a polymer or copolymer derived from an amine monomer selected from the group consisting of 4,4'diaminodiphenyl sulfone, 3,3'diaminodiphenyl sulfone, and mixtures thereof, the floc having a length of from 2 to 25 mm; and b) non-granular, fibrous or film-like polymer fibrids, the fibrids containing a polymer or copolymer derived from metaphenylene diamine, the fibrids having an average maximum dimension of 0.1 to 1 mm, a ratio of maximum to minimum dimension of 5:1 to 10:1, and a thickness of no more than 2 microns, wherein the papers have at least a 50% improvement in work-to-break values over papers made solely with poly(metaphenylene isophthalamide) floc.

2. The paper of claim 1 wherein weight ratio of fibrids to floc in the paper is from 95:5 to 3:97.

3. The paper of claim 2 wherein the weight ratio of fibrids to floc in the paper is from 60:40 to 10:90.

4. The paper of claim 1, wherein fibrids are made from poly(metaphenylene isophthalamide).

5. The paper of claim 4 wherein the poly(metaphenylene isophthalamide) fibrids are 50 to 80 weight percent of the total amount of fibrids in the paper.

6. The paper of claim 1, further comprising fibrids comprising polymer or copolymer derived from an amine monomer selected from the group consisting of 4,4'diaminodiphenyl sulfone, 3,3'diaminodiphenyl sulfone, and mixtures thereof.

TABLE 1

| Example | Floc type | Basis weight (g/m$^2$) | Thickness (mm) | Density (g/cm$^3$) | Work-to-break in MD (N-cm) | Work-to-break in CD (N-cm) | Elongation-at-break in MD (%) | Elongation-at-break in CD (%) |
|---|---|---|---|---|---|---|---|---|
| 1 | PSA | 39.0 | 0.127 | 0.31 | 34.0 | 22.4 | 8.53 | 10.65 |
| 2 | Blend of PSA and m-aramid | 39.0 | 0.123 | 0.32 | 27.7 | 21.3 | 6.05 | 9.10 |
| A | m-aramid | 40.0 | 0.123 | 0.32 | 20.8 | 14.5 | 4.92 | 6.32 |

TABLE 2

| Example | Floc type | Floc content, Wt. % | Basis weight (g/m$^2$) | Thickness (mm) | Density (g/cm$^3$) | Work-to-break (N-cm) | Elongation-at-break (%) | Shrinkage at 300 C., % |
|---|---|---|---|---|---|---|---|---|
| 3 | PSA | 47 | 66.8 | 0.127 | 0.53 | 57.1 | 8.54 | 0.3 |
| B | m-aramid | 47 | 67.8 | 0.118 | 0.57 | 34.0 | 4.96 | 0.5 |
| 4 | PSA | 70 | 67.8 | 0.151 | 0.45 | 22.8 | 5.45 | 0.3 |
| C | m-aramid | 70 | 69.8 | 0.136 | 0.51 | 12.1 | 2.98 | 0.5 |
| 5 | PSA | 85 | 67.8 | 0.166 | 0.41 | 6.1 | 3.31 | 0.3 |
| D | m-aramid | 85 | 70.2 | 0.142 | 0.49 | 3.0 | 1.84 | 0.5 |

7. The paper of claim 6 wherein the total amount of fibrids in the paper comprise 80 to 20 weight percent fibrids made from a polymer or copolymer derived from an amine monomer selected from the group consisting of 4,4'diaminodiphenyl sulfone, 3,3'diaminodiphenyl sulfone, and mixtures.

8. The paper of claim 1, further comprising:

c) floc selected from the group of para-aramid, meta-aramid, carbon, glass, polyethylene terephthalate, polyethylene napthalate, liquid crystalline polyesters, polyphenylene sulfide, polyether-ketone-ketone, polyether-ether-ketone, polyoxadiazole, polybenzazole, and mixtures thereof, the floc having a length of from 2 to 25 mm.

9. A wire or conductor wrapped with the paper of claim 1.

10. A laminate structure or electrical device comprising the paper of claim 1.

11. A honeycomb structure comprising the paper of claim 1.

* * * * *